US005085439A

United States Patent [19]

Lott

[11] Patent Number: 5,085,439

[45] Date of Patent: Feb. 4, 1992

[54] GAME BOARD, QUERY CARDS AND METHOD OF PLAYING A BLACK HISTORY GAME

[76] Inventor: Willie C. Lott, 3310 Chalfont Dr., Houston, Tex. 77066

[21] Appl. No.: 654,050

[22] Filed: Feb. 12, 1991

[51] Int. Cl.[5] ..... A63F 3/00

[52] U.S. Cl. ..... 273/236; 273/431

[58] Field of Search ..... 273/236, 242, 430, 431

[56] References Cited

U.S. PATENT DOCUMENTS

| | | | |
|---|---|---|---|
| 2,410,800 | 11/1946 | Baumgartner | 434/327 |
| 3,945,643 | 3/1976 | Breslow | 273/243 |
| 4,643,429 | 2/1987 | Crandon et al. | 273/251 |
| 4,736,954 | 4/1988 | Haney et al. | 273/236 |
| 4,807,878 | 2/1989 | Tripp | 273/237 X |

FOREIGN PATENT DOCUMENTS

| | | | |
|---|---|---|---|
| 2205254 | 12/1988 | United Kingdom | 273/254 |
| 2211750 | 7/1989 | United Kingdom | 273/254 |
| 2218647 | 11/1989 | United Kingdom | 273/254 |
| 2219744 | 12/1989 | United Kingdom | 273/254 |

*Primary Examiner*—William H. Grieb
*Assistant Examiner*—William E. Stoll

[57] ABSTRACT

A game comprised of a game board with a plurality of squares and a plurality of query cards for each square. The squares are equally divided amongst four playing positions, with a plurality of these squares at each playing position being one color and a plurality of them being another color with the squares of the same color being grouped together at each playing position. Each square has one number in it which corresponds with the number totals likely to occur with the roll of a pair of dice with a plurality of the number being duplicated in squares of both colors. One set of squares besides having a number in them also have subject titles in them. Each player in turn, rolls a pair of dice and the total of the dots facing up on the dice indicates the square on which the player is to place a chip and the score to be obtained in accordance with scoring instructions printed on the query card if the question is answered correctly by the player. Play proceeds until a player attains a score equal to the result obtained when the year 1863 is subtracted from the current year.

2 Claims, 1 Drawing Sheet

GAME BOARD, QUERY CARDS AND METHOD OF PLAYING A BLACK HISTORY GAME

BACKGROUND OF THE INVENTION

1. FIELD OF THE INVENTION

The invention relates to a multicolored game board with a plurality of squares and a method of playing a game that pertains to the history and culture of Black people. This game also contains a plurality of query cards which serve to generate game play.

2. DESCRIPTION OF THE PRIOR ART

While an abundance of board games exist, none could be found which relate to the achievements, contributions, literature, activities, organizations, culture or any other aspect of the experiences of Black people.

There are some other patented games for educational and recreational purposes that utilize a board with cards that generate game play such as "Game Apparatus" U.S. Pat. No. 4,872,681, "Concept Integration Board Game" U.S. Pat. No. 4,846,479, "Question and Answer Game" U.S. Pat. No. 4,736,954 and "Problem Solving Game" U.S. Pat. No. 4,679,796.

The aforementioned patented games each utilize game boards and a method of play in which cards are used. However, the configuration of the game board for which this application is submitted is unique to this game. The questions, answers, scoring method, method of play and subject matter are different from those previously patented. In addition to intellectual game play, this game also involves physical activity.

No other game method of play, game board configuration or query cards were found to exist that were in any way similar to those for which this application is submitted. Additionally, no patent could be found that related to the subject matter of this invention.

SUMMARY OF THE INVENTION

The primary object of this invention is to provide a method of play for a game pertaining to the history and culture of Black people in a way that is positive, educational and entertaining.

An additional object is to provide a game board to facilitate the playing of the game about the history and culture of Black people.

Another object is to provide a plurality of query cards on which are printed questions, answers to those questions and scoring and activity instructions which combine to generate game action.

The game, game board, method of play and query cards addressed in this application successfully achieve all the preceding objects as has been proven by family members playing the game during its development. In the preferred embodiment of this invention, the game board is multicolored with a plurality of squares evenly divided amongst four playing positions. The board can be folded at its geometric center to facilitate storage. The query cards are also multicolored to correspond to the playing positions they relate to on the game board.

DETAILED DESCRIPTION

Figure 1:
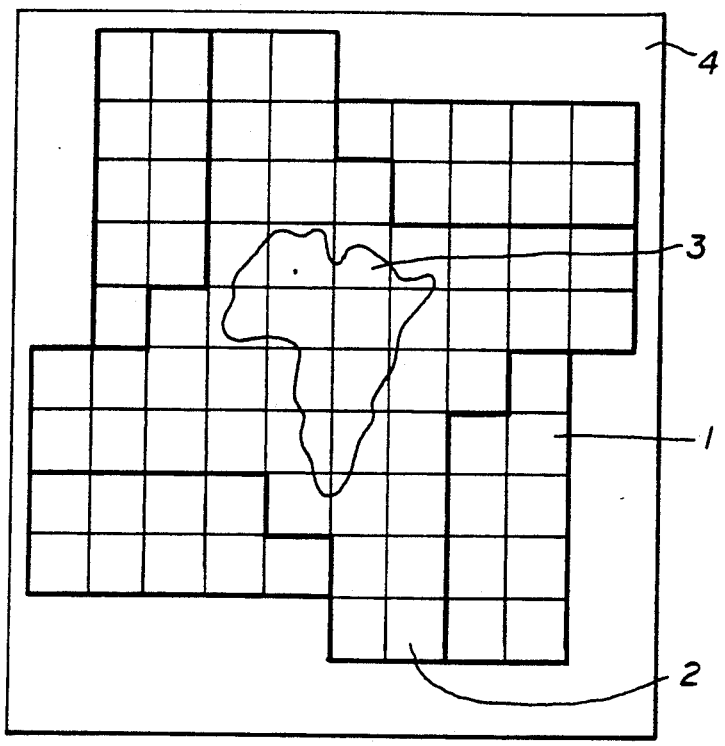
FIG. 1 is a plan view of the game board, unfolded in its playing position.

As shown in the drawings, the game board at FIG. 1 consists of a board that has a plurality of squares. Squares 1, the boundaries of which are shown in thick lines, contain numbers 3 through 11 and subject titles and are of one color.

Squares 2 contains numbers only, 2 through 12 and are of a different color than squares 1. All squares are bordered in the same color which contrasts them both.

Outline 3 in the center of the game board is a depiction of the Continent of Africa. On the game board, the boundaries of all countries comprising the continent are outlined within the outline.

Boundary 4 shows the limits of the game board. The boundary color is the same as the color of the lines outlining the squares and the Continent of Africa.

Figure 2:
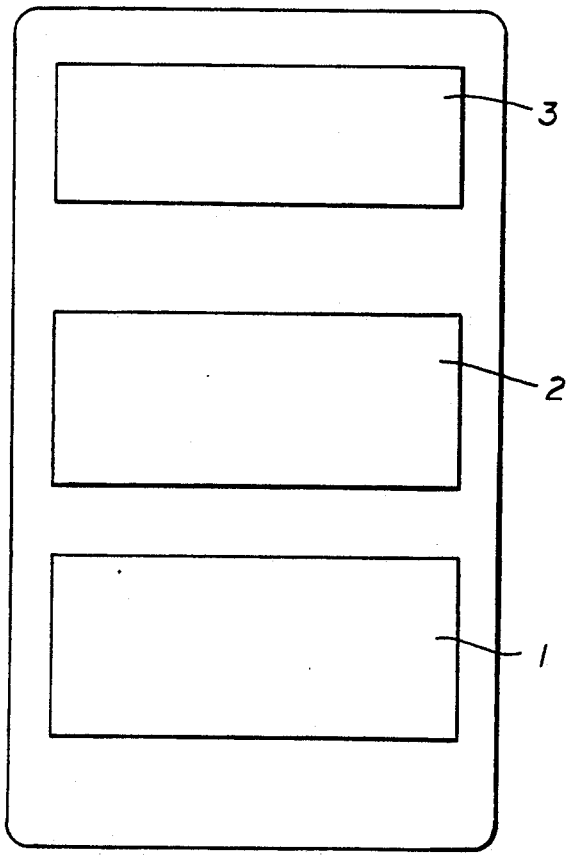
FIG. 2 is a depiction of a query card showing the side on which the questions, answers and scoring and game play instructions are printed.

FIG. 2 shows the back of a typical query card. Space 1 is where the question will be printed. Space 2 is where the answers will be printed. Space 3 is where the scoring and game play instructions will be printed.

Four players will position themselves around the board with the sections protruding at the bottom of the board at each position, being the playing position. FIG. 1 is situated in such a way that the north playing position is at the top of the page, with south, east and west being situated in their normal positions. For the squares 2, there is a plurality of general query cards, while for squares 1, there is a plurality of specific query cards that correspond with the subject titles in the squares. In squares 1, there is also a square which is titled current events; players are required to provide a query from a current periodical. All query cards are contained in boxes and during play, they are retained for each position by the player opposite that position. When a player is to respond to a query, the player retaining the cards opposite the responding players position asks the question(s). A plurality of some of the squares are superimposed over the map of Africa. During the course of the game, a card will occasionally require players to respond to questions about African countries whose boundaries are within the playing position squares. The playing positions are designated north, south, east and west and are so positioned that they coincide with the geographical orientation of the African continent.

To play the game, four players determine which player is to play at which playing position. Once the players are situated around the game board, the north player starts the game by rolling a pair of dice, with subsequent play being in the sequence east, south and then west. The total of the dots resulting from the dice roll is the numbered square on the game board on which players place chips once a question or game action has been correctly complied with. This number also determines the score to be received per instructions contained on the query card(s). Each player position has a plurality of squares which contain the same individual number and the player must decide on which of these squares to play. If the player elects to play on one of the squares (squares 2) that contains a number only, that player will be asked questions from the general category cards. Should the player elect to play on one of the squares containing a number and a subject title (squares 1), the player will be asked questions from query cards that contain specific subject questions which correspond with the titles that are printed in the squares on the game board. The player can also elect to pass. If the player passes or answers any question incorrectly, all players, except the player opposite the player who passed or answered incorrectly, may attempt to answer the question. If they are unsuccessful, they will not be penalized.

However, if one of them answers the question correctly, that player is awarded the score and the player who initially passed or answered the question incorrectly, will place a chip on the numbered square at his/her playing position to indicate that he/she cannot play on that particular square again. It is possible for all players to play some numbers twice and an open square can be played upon regardless of the status of the other square that has the same number. Once both like numbered squares at a position have chips on them, the player at the position must pass if he/she rolls that number again. When this occurs, the player must pass and no other player is given an opportunity to respond to the question, instead, play continues in the normal sequence. Additionally, this player cannot respond to a question for this number if it is rolled by another player and that player either passes or answers incorrectly. Incorrect answers by the player whose turn it is results in that player relinquishing the dice to the player whose turn it is next. Correct answers, by the player whose turn it is, from the general category cards will cause the player to be allowed to continue to play and attain scores until he/she passes or answers incorrectly. Correct answers, by the player whose turn it was, to a question from the query cards with subject titles on them shall result in the player attaining the score, but he/she shall relinquish the dice to the person whose turn it is next to play.

If a player covers all squares at his/her playing position, but does not have the required number of points to win the game, players will change their positions one place to their right. All chips at all positions will be removed from the game board and play will resume with the player whose turn was next to occur.

Play will continue in this manner until a player attains a score that is equal to or more than the result obtained when the year the Emancipation Proclamation was signed is subtracted from the current year (e.g. 1991 − 1863 = 128; the winning score for 1991 is 128).

I claim:

1. A folding multicolored game board with a plurality of squares equally divided amongst and apportioned to each of four playing positions with these squares further subdivided at each playing position into two sets of a plurality of playing squares with both sets being of a different color, a plurality of these squares being outlined over a representation of the continent of Africa on the game board and each country of Africa being outlined, all squares have a number printed in them that corresponds to the total of the dots that might occur with the roll of a pair of dice, a plurality of these square having numbers and printed subject titles in them, a plurality of game cards called query cards some of which are general subject cards providing questions, answer, scoring, and game instructions corresponding to the squares which contain numbers only, and a plurality of specific query cards providing questions, answers, scoring, and game instructions corresponding to the game board squares containing the appropriate specific subject titles.

2. A method of play for a board game that pertains to the history and culture of Black people comprising positioning four players, one at each of four playing positions, players taking turns rolling a pair of dice seeking opportunities to answer questions off query cards, which are posed by the player opposite the player who rolled the dice, about Black culture and history for which certain scores are awarded and certain instructions are given from query cards with play continuing and progressing until a player attains the required winning score that shall be a number equal to or exceeding the number that results when the year 1863 is substracted from the current year.

* * * * *